US009199149B2

(12) United States Patent
Max et al.

(10) Patent No.: US 9,199,149 B2
(45) Date of Patent: Dec. 1, 2015

(54) GAME APPARATUS

(76) Inventors: Brad Max, Kansas City, MO (US); Jay Todd Max, Kansas City, MO (US)

( * ) Notice: Subject to any disclaimer, the term of this patent is extended or adjusted under 35 U.S.C. 154(b) by 221 days.

(21) Appl. No.: 13/412,353

(22) Filed: Mar. 5, 2012

(65) Prior Publication Data

US 2012/0225742 A1 Sep. 6, 2012

Related U.S. Application Data

(60) Provisional application No. 61/448,956, filed on Mar. 3, 2011, provisional application No. 61/498,302, filed on Jun. 17, 2011, provisional application No. 61/532,893, filed on Sep. 9, 2011.

(51) Int. Cl.

| | |
|---|---|
| ***A63B 63/00*** | (2006.01) |
| ***A63B 63/08*** | (2006.01) |
| ***A63B 67/00*** | (2006.01) |
| *A63B 67/06* | (2006.01) |
| *A63B 71/00* | (2006.01) |
| *A63F 7/00* | (2006.01) |

(52) U.S. Cl.

CPC ..... *A63B 63/08* (2013.01); *A63B 67/002* (2013.01); *A63B 67/06* (2013.01); *A63B 71/0036* (2013.01); *A63B 2210/50* (2013.01); *A63B 2225/093* (2013.01); *A63F 7/0017* (2013.01); *A63F 2250/024* (2013.01)

(58) Field of Classification Search

CPC ..... A63B 67/06; A63B 63/00; A63B 63/08; A63B 2063/001

USPC ..... 473/476–478, 431–433; 273/394–402

See application file for complete search history.

(56) References Cited

U.S. PATENT DOCUMENTS

| | | | | | |
|---|---|---|---|---|---|
| 922,717 | A | * | 5/1909 | Parker | 273/401 |
| 1,279,654 | A | * | 9/1918 | Charlesworth | 273/399 |
| 1,537,738 | A | * | 5/1925 | Bisbing | 273/390 |
| 1,616,270 | A | * | 2/1927 | Madden | 273/401 |
| 2,326,859 | A | * | 8/1943 | Hoover | 273/396 |
| 2,540,288 | A | * | 2/1951 | Powers | 273/402 |
| 2,552,446 | A | * | 5/1951 | O'Conner | 273/390 |
| 2,744,752 | A | * | 5/1956 | Arnold | 273/398 |
| 3,458,196 | A | * | 7/1969 | Monzulla et al. | 273/396 |
| 3,674,270 | A | | 7/1972 | Benjamin et al. | |
| 3,822,063 | A | | 7/1974 | Rea | |
| 4,012,042 | A | * | 3/1977 | Blasingame | 273/401 |
| 4,066,262 | A | * | 1/1978 | Stiefel | 273/400 |
| 4,085,933 | A | | 4/1978 | Currie | |
| D270,920 | S | | 10/1983 | Branom | |
| 4,565,375 | A | * | 1/1986 | Dresel | 273/401 |
| 4,709,929 | A | * | 12/1987 | Mills et al. | 273/402 |
| 4,750,744 | A | * | 6/1988 | Michalec | 473/195 |
| 5,042,813 | A | * | 8/1991 | Huang | 473/153 |
| 5,056,796 | A | * | 10/1991 | Conville | 273/402 |
| 5,123,656 | A | | 6/1992 | Green | |
| 5,201,527 | A | * | 4/1993 | Koket | 273/402 |
| 5,228,691 | A | * | 7/1993 | McAlley | 273/317.3 |
| D341,381 | S | | 11/1993 | Niebling | |

(Continued)

*Primary Examiner* — Mark Graham

(74) *Attorney, Agent, or Firm* — Polsinelli PC; Adam C. Rehm

(57) ABSTRACT

A portable game apparatus having two identical free-standing units that can be assembled and used independently or together in an opposing or side-by-side arrangement. The game apparatus is convertible to and from a use configuration and a storage configuration. In the storage configuration, the game apparatus is a single unit with a cavity formed therein to house all of the parts of the game apparatus.

7 Claims, 4 Drawing Sheets

(56) References Cited

U.S. PATENT DOCUMENTS

| | | | | | |
|---|---|---|---|---|---|
| 5,290,040 | A | | 3/1994 | Boroski | |
| 5,351,968 | A | * | 10/1994 | Starnes | 273/348.4 |
| 5,393,049 | A | * | 2/1995 | Nelson | 473/433 |
| 5,433,433 | A | | 7/1995 | Armell | |
| 5,573,252 | A | * | 11/1996 | Simmons | 273/454 |
| 5,632,490 | A | * | 5/1997 | Brown | 273/350 |
| 5,842,939 | A | | 12/1998 | Pui et al. | |
| D407,764 | S | | 4/1999 | Ashton et al. | |
| 6,315,677 | B1 | * | 11/2001 | Sandlin | 473/197 |
| 7,235,025 | B2 | | 6/2007 | Quinn | |
| 7,900,928 | B2 | | 3/2011 | Held et al. | |
| 7,988,154 | B1 | * | 8/2011 | Regan, Jr. | 273/348 |
| 2003/0216195 | A1 | * | 11/2003 | Britto et al. | 473/481 |
| 2006/0066054 | A1 | * | 3/2006 | Menendez | 273/348 |
| 2008/0157476 | A1 | * | 7/2008 | Striebel et al. | 273/402 |
| 2010/0058958 | A1 | * | 3/2010 | Christian et al. | 108/19 |
| 2012/0169012 | A1 | * | 7/2012 | Parker et al. | 273/400 |
| 2012/0256378 | A1 | * | 10/2012 | Brown | 273/401 |

* cited by examiner

GAME APPARATUS

CROSS-REFERENCE TO RELATED APPLICATIONS

This patent application is the non-provisional filing of and claims priority to U.S. Provisional Patent Applications Ser. No. 61/448,956 filed Mar. 3, 2011, Ser. No. 61/498,302 filed Jun. 17, 2011, and Ser. No. 61/532,893 filed Sep. 9, 2011, the entire contents of which are herein incorporated by reference in their entireties.

BACKGROUND

1. Field

Embodiments of the present invention relate to a game. More particularly, embodiments of the present invention relate to a portable game having two identical free-standing units that can be assembled to oppose each other or stand side-by-side in a use configuration and converted to a storage configuration as a single unit.

2. Discussion of Related Art

Games provide a number of benefits including a source of entertainment for mental stimulation, social interaction, and improving dexterity. The game of "beirut" or "beer pong" has recently grown in popularity. The game generally involves placing six or ten 18-ounce or 16-ounce drinking cups in triangular formation at each end of an 8×2 foot table. Each of the cups is filled with approximately one inch of a liquid, such as beer or another alcoholic beverage. After filling of the cups, two-member teams, standing at opposite ends of the table, take turns tossing regulation 40-millimeter ping pong balls at cups, i.e., the opponent's cups, at the other end of the table, with the objective of tossing the balls into the cups. When a ball goes into the opponent's cup, the cup is removed from the table and the liquid contents must be consumed by the opponents.

In its early forms, the game was primarily used as a drinking game, in dank and seamy shadows of college fraternity basements, for users consuming large quantities of beer. In recent years, however, the game has evolved considerably, has gained a significant degree of luster, and is generally respected as a sport and major social pastime. The game is played in many social settings, such as at tailgates, cookouts, picnics, television-game watching parties, fraternity and sorority parties, and family get-togethers. Weekly "beer pong tournaments" are springing up in most large and medium-sized U.S. cities. In January of 2012, a tournament, commonly known as THE WORLD SERIES OF BEER PONG®, was held in Las Vegas, Nev. for the seventh year in a row, which attracted a record group of over 400 teams from 45 states, five Canadian provinces, and several other foreign countries. In many of these contests, beer is replaced by water to focus on the athletic aspect of the game.

SUMMARY

The following brief summary is provided to indicate the nature of the subject matter disclosed herein. While certain aspects of the present invention are described below, the summary is not intended to limit the scope of the present invention. Embodiments of the present invention provide a portable game having two identical free-standing units that can be assembled to oppose each other or stand side-by-side in a use configuration and converted to a storage configuration as a single unit.

It is an object of the present inventive concept to provide a game apparatus that can be easily assembled by a user in less than two minutes, can be assembled and played on any surface in an area as small as 12×5 feet, and is operable to store all equipment needed to utilize the game apparatus, e.g., balls, cups.

It is another object of the present inventive concept to provide a game apparatus that efficiently allows a user to develop skill, e.g., hand-eye coordination, aim, for tossing projectiles, e.g., balls, at a target, e.g., cups, and provides targets in a variety of configurations for various degrees of difficulty.

It is another object of the present inventive concept to provide a game apparatus that captures and routes projectiles, e.g., balls, to a single location for easy retrieval by the user, thereby providing a game with increased efficiency.

It is another object of the present inventive concept to provide a game apparatus that may be stored, in its stored configuration, in a space that is less than seven inches long and 23 inches wide to facilitate portability for use of the game apparatus at tailgating events, picnics, and similar outdoor and/or indoor social gatherings.

It is another object of the present inventive concept to provide a game apparatus that provides additional functionality to traditional games by, among other things, enhanced portability of the game apparatus and increased variables to accommodate a wide range of users.

It is another object of the present inventive concept to provide a game apparatus that provides a surface for use with other games such as, but not limited to darts, skee ball, around the world, horse, traditional beer pong, and the like.

The aforementioned objects and/or aspects may be achieved in one aspect of the present invention by providing a game apparatus including a frame having a horizontal playing surface with at least one aperture extending through the frame, a plurality of legs secured to the frame, and/or an elongated funneling element depending from the frame operable to route an object received from the at least one aperture to a location that is remote from the playing surface.

The game apparatus may further include a backboard secured to the frame and at least partially extending about the playing surface. The backboard may include a plurality of apertures extending through the backboard. The game apparatus may further include at least another aperture extending through the frame having a smaller diameter than a diameter of the at least one aperture extending through the frame. The aperture may extend through the frame is adjacent to the backboard. The location may be a mouth of the funneling element operable to allow the object to exit the funneling element.

The aforementioned objects and/or aspects may be achieved in another aspect of the present invention by providing a reconfigurable game apparatus including a first unit and a second unit selectively reconfigurable between (i) a storage configuration and (ii) a use configuration. The first and second units may be fastened together and form a cavity therebetween for housing parts of the game apparatus in the storage configuration.

Each of the first and second units may include (i) a frame having a horizontal playing surface with at least one aperture extending through the frame, (ii) a plurality of legs secured to the frame, and/or (iii) an elongated funneling element depending from the frame operable to route an object received from the at least one aperture to a location that is remote from the playing surface. Each of the first and second units may include a backboard secured to the frame and at least partially extending about the playing surface. The backboard may include a plurality of apertures extending through the backboard or may be solid without apertures.

Each of the first and second units may include at least another aperture extending through the frame having a larger or smaller diameter than a diameter of the at least one aperture extending through the frame. The least another aperture may extend through the frame about a partial perimeter of the playing surface that is adjacent to the backboard or about an entire perimeter of the playing surface. The location is a mouth of the funneling element may be operable to allow the object to exit the funneling element.

The aforementioned objects and/or aspects may be achieved in another aspect of the present invention by providing a game apparatus including a frame having a playing surface with (i) at least one first receiver and (ii) at least one second receiver, the at least one first receiver adapted to support a target, the at least one second receiver adapted to receive an object therein, and/or a backboard secured to the frame and at least partially extending about the playing surface. The at least one first receiver may be an aperture sized and shaped to at least partially receive a cup therein. The target may be a drinking cup.

The at least one second receiver may be an aperture sized and shaped to receive an object tossed at the target. The at least one second receiver may be in communication with an elongated funneling element depending from the frame. The at least one second receiver and the funneling element may be operable to route an object tossed at the target to a location that is remote from the playing surface. The game apparatus may also include a plurality of legs secured to the frame.

Additional aspects, advantages, and utilities of the present invention will be set forth in part in the description which follows and, in part, will be obvious from the description, or may be learned by practice of the present invention.

BRIEF DESCRIPTION OF THE DRAWINGS

Embodiments of the present invention are described in detail below with reference to the attached drawing figures, wherein.

Figure 1:
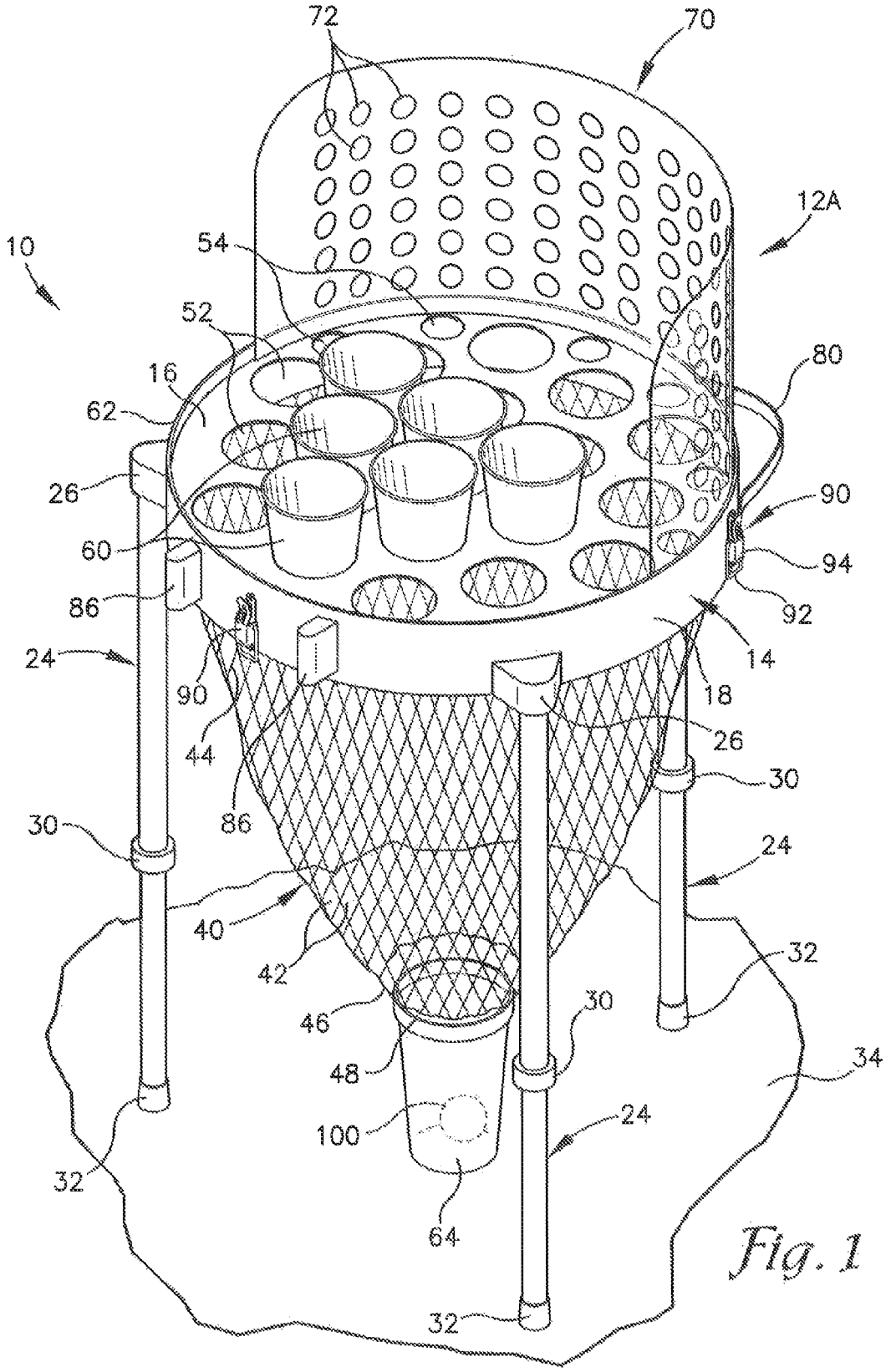
FIG. 1 is a perspective view of a game in accordance with various embodiments of the present invention illustrating one of the pair of identical free-standing units of the game assembled in a use configuration.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
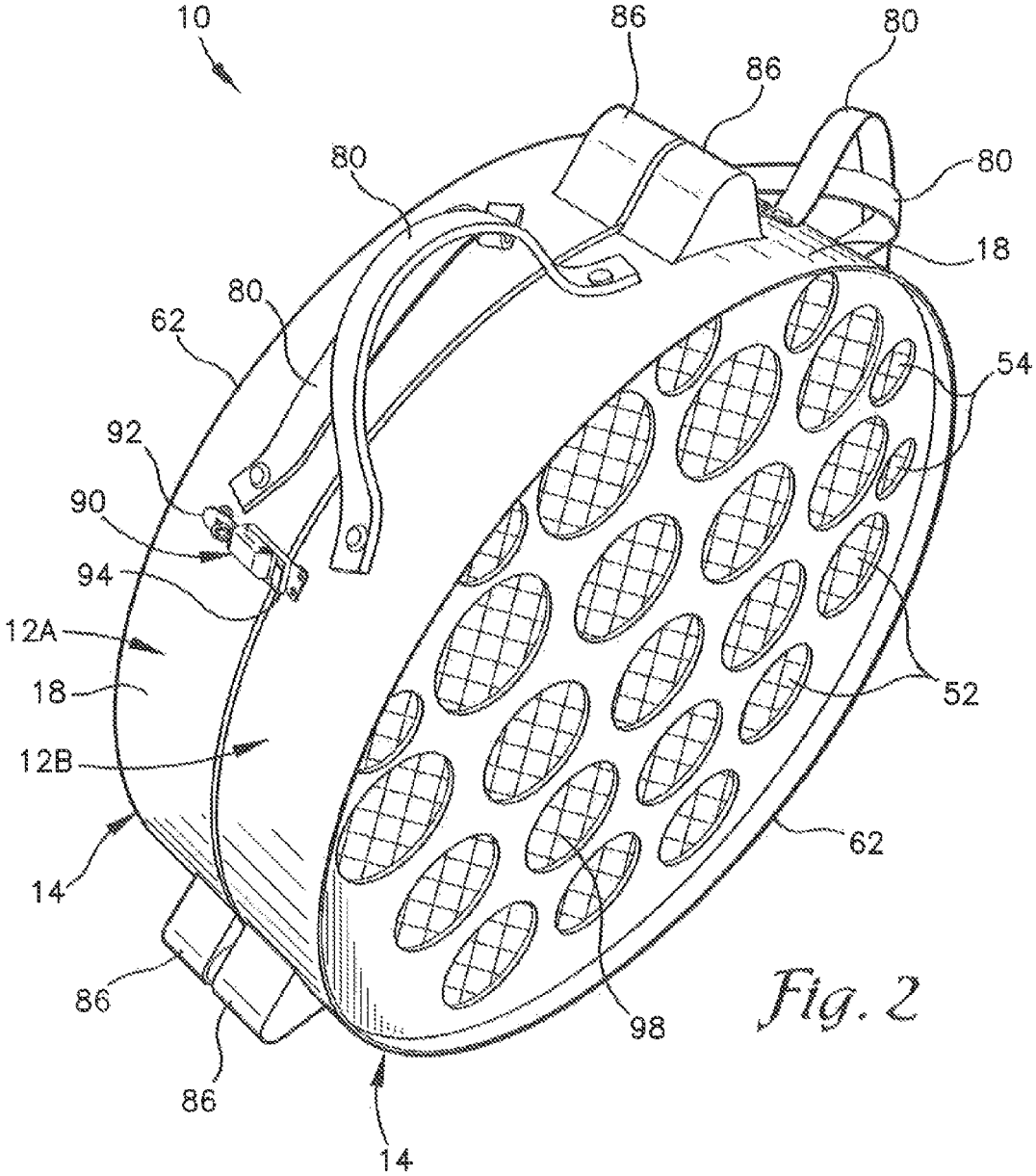
FIG. 2 is a perspective view of the game of FIG. 1, illustrating the pair of identical free-standing units converted to a storage configuration as a single unit.

Turning to FIGS. 1 and 2, a game apparatus 10, constructed in accordance with various embodiments of the present invention, is illustrated. The game apparatus 10 includes two identical free standing units 12A, 12B that are operable to be converted to and from a use configuration, as illustrated in FIG. 1, and a storage configuration in a single unit 14, as illustrated in FIG. 2. Although only the unit 12A is illustrated in the use configuration, the unit 12B is identical to the unit 12A and appears identical to the unit 12A when the unit 12B is assembled in the use configuration. For description purposes herein, only the unit 12A is described. It should be understood, however, that the unit 12B is identical to the unit 12A. Each of the units 12A, 12B mate to each other to form the single unit in the storage configuration.

The unit 12A generally includes a frame 14 having a planar game surface 16 secured within a perimeter wall 18. The game surface 16 and perimeter wall 18 extend perpendicular to each other. In the exemplary embodiment, the game surface 16 is circular. It is foreseen, however, that the game surface 16 may be any shape such as, but not limited to, square, oval, triangular, rectangular, or the like without deviating from the scope of the present inventive concept.

The frame 14 is elevated in the use configuration by a plurality of telescoping legs 24 that are each independently and removably received into one of a plurality of leg receivers 26, via a friction-fit engagement, which are secured to the perimeter wall 18. The leg receivers 26 are circumferentially positioned about the perimeter wall 18 and are equidistant to each other. Each of the legs 24 include locking means 30 operable to selectively lock and/or unlock its corresponding one of the legs 24 in either an extended configuration for use and/or a retracted configuration for storage. Each of the legs 24 include a cap 32 operable to increase friction of its corresponding one of the legs 24 and a supporting floor or ground surface 34.

An elongated funneling element 40 is secured to the frame 14 and/or the game surface 16 and depends from the frame 14 and/or the game surface 16 when the unit 12A is in the use configuration. In the exemplary embodiment, the funneling element 40 is formed of a non-rigid mesh or net-like material having a plurality of apertures 42 operable to permit air to substantially flow therethrough. It is foreseen, however, that the funneling element 40 may be a rigid and/or solid material, such as a sack or the like, without deviating from the scope of the present inventive concept.

The funneling element 40 is closed except for an open upper end 44 and an open lower end 46. The funneling element 40 is conical or tapered with the upper end 44 having a greater diameter than a diameter of the lower end 46. A circumferential delivery element or mouth 48 is provided at the lower end 46. In the exemplary embodiment, the mouth 48 is open. It is foreseen, however, that the mouth 48 may be selectively opened or closed via a drawstring, a lid, and/or the like without deviating from the scope of the present inventive concept.

Figure 3:
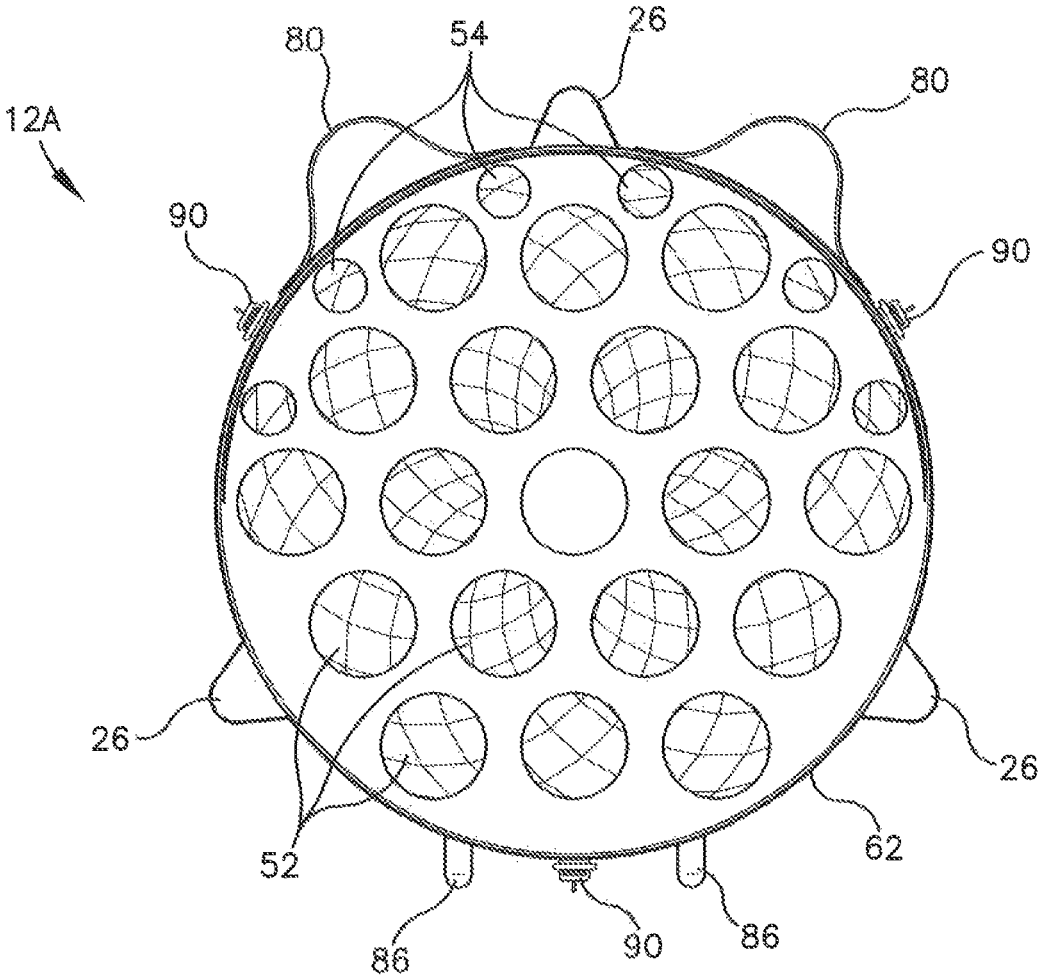
FIG. 3 is a top plan view of the game of FIG. 1.

Turning to FIG. 3, the game surface 16 includes a plurality of apertures 52, 54 to permit communication through the game surface 16 and from an outside area above the game surface 16 to an inside of the funneling element 40. In the exemplary embodiment, the game surface 16 includes nineteen of the apertures 52, which are of the same size and shape, that is, circular, and six of the apertures 54, which are of the same size and shape, that is, circular. The apertures 52 have a larger diameter than the apertures 54. It is foreseen, however, that the plurality of apertures 52, 54 may be of any number and/or of different sizes and/or shapes without deviating from the scope of the present inventive concept. For instance, the game surface 16 may have twelve apertures 54.

Figure 4:
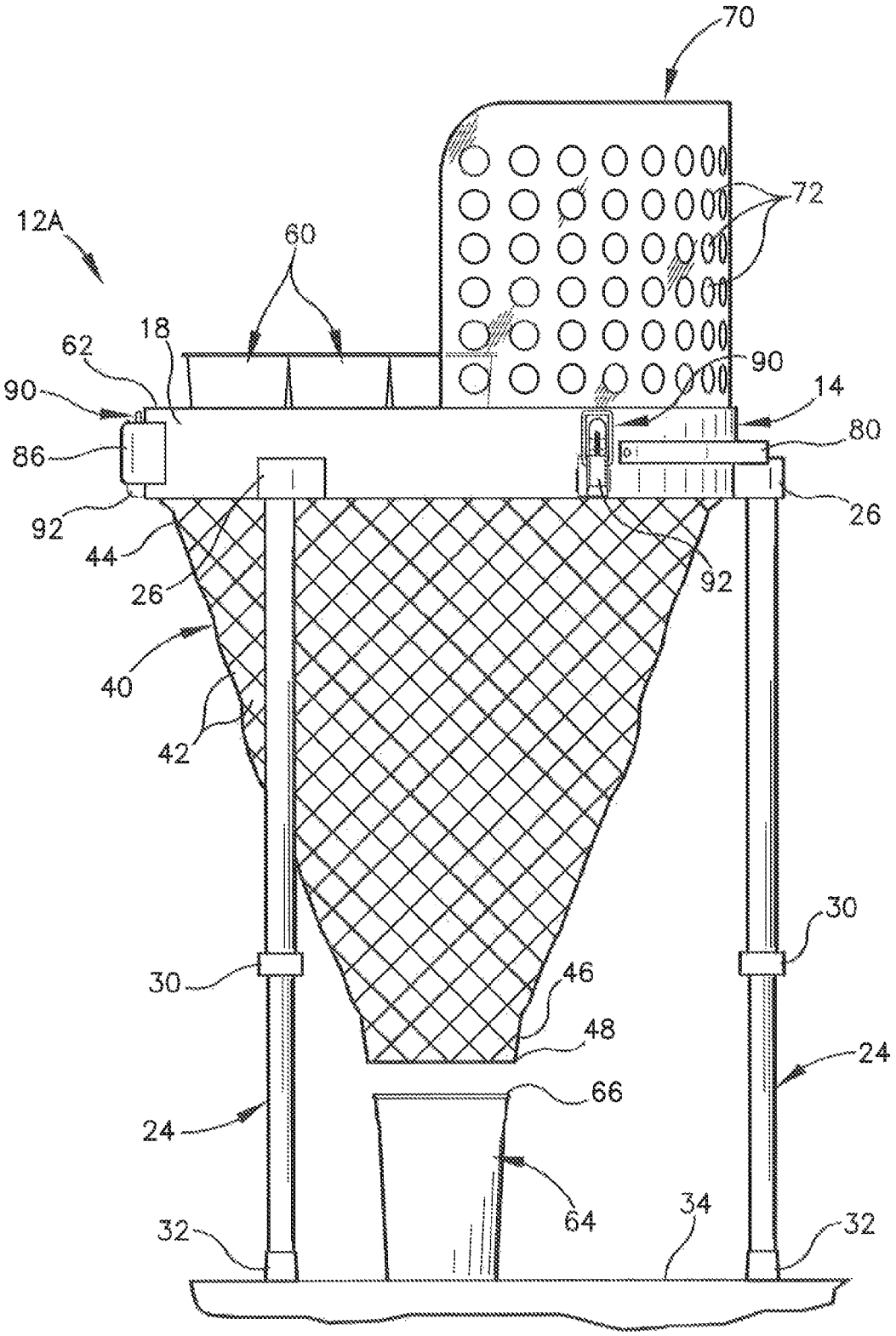
FIG. 4 is a left side view of the game of FIG. 1.

The plurality of apertures 52 are sized and shaped to only partially receive a bottom portion of 18-ounce to 16-ounce cups 60. For example, traditional cups with bottoms thereby allowing the cups 60 to hold a liquid and/or solid, such as cups sold under the brand SOLO®, may be utilized. It is foreseen, however, that the one or more of the cups 60 may be pass-through cups having no bottom surface or their bottom surface removed, thereby preventing the pass-through cups from holding a liquid and/or solid, without deviating from the scope of the present inventive concept. The plurality of apertures 52 are of a sufficient diameter such that, when the cups 60 are fitted into each of the plurality of apertures 52, the cups 60 extend above the game surface 16 and a rim 62 of the perimeter wall 18 and are visible from a side view, as illustrated in FIG. 4. The game surface 16 is operable to place the cups 60 at generally the same height as found in various official and unofficial tournaments.

A collector cup 64, which may be the same as or similar to one of the cups 60 with a bottom surface to enable holding a liquid and/or solid, is placed directly below the mouth 48 of the funneling element 40. The funneling element 40 is of a sufficient length that, when the unit 12A is in the use configuration and the funneling element 40 is depending therefrom, the mouth 48 of the funneling element 40 abuts or is approximately two inches above a rim 66 of the collector cup 64 when the collector cup 64 is placed on the ground 34. Additionally, the mouth 48 of the funneling element 40 and the rim 66 of the collector cup 64 have equal or substantially equal diameters, so that the mouth 48 of the funneling element 40 and the rim 66 of the collector cup 64 may be horizontally aligned with each other.

Extending approximately perpendicular to and at least partially surrounding a rear of the game surface 16 is a removable guard panel or backboard surface 70. In the exemplary embodiment, the backboard surface 70 extends around 40%-60% of the game surface 16, and preferably around 45%-55%, and more preferably around 50%. It is foreseen, however, that the backboard surface 70 may extend around any percent of the backboard surface 70 without deviating from the scope of the present inventive concept.

The backboard surface 70 preferably extends between approximately parallel with or 0° from a vertical plane defined by the perimeter wall 18 and 20° away from the game surface 16, and more preferably is flared such that the backboard surface 60 extends between 5° and 15° away from the game surface 16 relative to the vertical plane, and most preferably is flared such that the backboard surface 60 extends 10° away from the game surface 16 relative to the vertical plane. The backboard surface 70 includes a plurality of apertures 72 operable to permit air to substantially flow therethrough. It is also foreseen, however, that the backboard surface 70 may be provided without any of the apertures 72, that is, as a solid element, without deviating from the scope of the present inventive concept. The backboard surface 70 is made of a resilient, substantially transparent material, such as plastic, so that the backboard surface 70 is operable to be rolled into a small tube when not in use and unrolled when in use and fitted to the game surface 16. In use, the backboard surface 70 rests on and selectively mates with the game surface 16 via corresponding tabs and slots. Additionally, the resiliency of the backboard surface 70 causes the backboard surface 70 to press against the perimeter wall 18, thereby facilitating a secure connection between the backboard surface 70 and the game surface 16.

The frame 14 includes two handles 80 that are each secured to the perimeter wall 18. In the exemplary embodiment, each of the units 12A, 123 include two handles 80. It is foreseen, however, that the units 12A, 12B may each have one of the two handles 80 without deviating from the scope of the present inventive concept. In the exemplary embodiment, the handles 80 are resilient and made of leather. It is foreseen, however, that the handles 80 may be made of any material such as, but not limited to plastic or metal, without deviating from the scope of the present inventive concept.

On an opposite side of the frame 14 relative to the two handles 80 are feet 86 operable to permit the game apparatus 10 to stand upright when in the stored configuration so that the two handles 80 extend upwardly. The feet 86 are made of a resilient material operable to increase friction between the feet 86 and a supporting floor or the ground surface 34. In the exemplary embodiment, the feet 86 are made of rubber. It is foreseen, however, that the feet 86 may be made of any material such as, but not limited to plastic or metal, without deviating from the scope of the present inventive concept.

Also secured about the frame 14 is a plurality of fasteners 90 or at least portions thereof. Each of the fasteners 90 include a latch 92 and a catch 94 operable to receive a portion of the latch 92 on one of the units 12A, 12B. In the exemplary embodiment, the unit 12A includes the latch 92 of each of the fasteners 90 and the unit 123 includes the catch 94 of each of the fasteners 90 on their respective perimeter walls 18. In this manner, the units 12A, 12B are operable to be selectively secured together in the storage configuration. In the exemplary embodiment, three of the fasteners 90 are used, which are positioned equidistant to each other about the perimeter wall 18 and are situated such that, when the units 12A, 123 are fitted together in the storage configuration, the latch 92 and the catch 94 of each of the fasteners 90 are aligned. It is foreseen that any number of fasteners 90 such as, but not limited to two fasteners 90, and/or any type of fastener may be used to secure the units 12A, 123 together without deviating from the scope of the present inventive concept.

In this manner, the game apparatus 10 is easily converted to and from the use and storage configurations by a user. In the storage configuration, all of the aforementioned elements of the game apparatus 10 fit together in a cavity 98 formed by each game surface 16 and each perimeter wall 18 of the units 12A, 128. The funneling element 40 prevents smaller elements such as, but not limited to a game ball 100, from exiting the cavity 98 via the apertures 52, 54. In other words, the apertures 42 of the funneling element 40 are sufficiently small, that is, smaller than a diameter of the game ball 100, so that the game ball 100 or other balls or other objects are prevented from exiting the cavity 98. It is foreseen that a bag may be provided for holding one or more of the game balls 100. The bag may be sized and shaped to fit entirely within the cavity 98, for instance, at least partially within the collector cup 64 housed within the cavity 98, while securely holding the game balls 100 when the game apparatus 10 is in the stored configuration, and may have an adapter such as a hook to hang from the game apparatus 10 when the game apparatus 10 is in the use configuration. For example, the bag may have a carrying strap or pull-string sized and shaped to at least partially nest within a horizontal groove formed in an uppermost outer end of one or more of the leg receivers 26. It is foreseen that the units 12A, 12B may have corresponding mating parts, for example, one or more pegs and holes to receive each of the one or more pegs, to facilitate a secure connection between the units 12A, 12B and prevent rotation therebetween when in the storage configuration.

In use, one or both of the units 12A, 12B are converted to the use configuration and positioned to oppose and at a distance from each other, for example, eight feet. It is foreseen that the units 12A, 12B may be used independent from each other. The game apparatus 10 may adapt to a user's skill level by increasing or decreasing the distance between the units 12A, 12B and/or by placing only one or up to 19 cups 60 of the same or varying sizes in a variety of configurations on the game surface 16 of each unit 12A, 128. In this manner, the game apparatus 10 permits beer pong sportsmen and sportswomen to re-create the actual beer pong game for competition or practice.

With the units 12A, 128 in the use configuration, a participant stands or sits at a remote position from one of the units 12A, 12B, for example, eight feet, which is the regulation distance, and tosses one of the game balls 100 at the unit 12A, 12B with the objective of landing the game ball 100 in one of the cups 60. If the participant is successful and the game ball 100 lands in one of the cups 60, the game ball 100 is contained within the cup 60. If the participant is unsuccessful and the game ball 100 does not land in one of the cups 60, but lands on the game surface 16, which may occur with or without first contacting the backboard 70, the game ball 100 passes through one of the plurality of apertures 52, 54, into the funneling element 40, and into the collector cup 64 for easy retrieval by the participant or another user. The apertures 54 are located adjacent to the backboard 70 to permit the game ball 100 to pass through the game surface 16, thereby preventing the game ball 100 from becoming stuck on the game surface 16. If the participant is unsuccessful and the game ball 100 does not and in one of the cups 60 or on the game surface 16, the participant will have to retrieve the game ball 100.

It is foreseen that a deflector element may be employed instead of the collector cup 64 to deflect the game ball 100 back to the participant without deviating from the scope of the present inventive concept. The deflector element may have a planar surface that is angled, e.g., at approximately 45 degrees toward the participant.

In this manner, the game apparatus 10 provides a highly adaptable, convenient, and low-cost, two unit 12A, 12B set. Party hosts at tailgates, cookouts, picnics, TV-game watching parties, fraternity and sorority parties, and family get-togethers can provide their guests with an active and engaging game, in a highly portable and easy-to-use package. These party hosts can offer a novel approach to beer pang for those guests familiar with the game, and an easily accessible introduction for those who are not.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A reconfigurable game apparatus comprising:

a first unit and a second unit selectively reconfigurable between (i) a storage configuration and (ii) a use configuration, the first and second units operable to be fastened together to form a cavity therebetween for housing parts of the game apparatus in the storage configuration; and each of the first unit and the second unit having (i) a plurality of apertures, and (ii) an elongated funneling element, wherein each of the elongated funneling elements is operable to (i) prevent the parts of the game apparatus from exiting the cavity formed by the first unit and the second unit through the plurality of apertures when the first unit and the second unit are in the storage configuration, and (ii) route an object received from any of the plurality of apertures in a respective one of the first and second units to a collection area outside of the elongated funneling element in the use configuration.

2. The apparatus according to claim 1, wherein, each of the first and second units includes (i) a frame having a horizontal playing surface with the apertures extending through the frame, and (ii) a plurality of legs secured to the frame, the elongated funneling element depends from the frame operable to route an object received from the apertures to a location that is remote from the playing surface.

3. The apparatus according to claim 2, wherein each of the first and second units includes a backboard secured to the frame and at least partially extending about the playing surface.

4. The apparatus according to claim 3, wherein the backboard includes a second plurality of apertures extending through the backboard.

5. The apparatus according to claim 3, wherein the plurality of apertures of each of the first and second units include at least one aperture extending through the frame having a smaller diameter than a diameter of others of the plurality of apertures extending through the frame.

6. The apparatus according to claim 5, wherein the at least one aperture extends through the frame adjacent to the backboard.

7. The apparatus according to claim 2, wherein the location is a mouth of the funneling element that is spaced from a surface beneath the mouth to allow the object to exit the funneling element and enter a receiver placed (i) between the surface and the mouth, and (ii) in the collection area outside of the elongated funneling element in the use configuration.

* * * * *